United States Patent [19]

Allred

[11] 4,284,138

[45] Aug. 18, 1981

[54] COATED SCREEN JACKET AND COATED PIPE BASE ASSEMBLY AND METHOD OF MAKING SAME

[75] Inventor: Richard E. Allred, St. Paul, Minn.

[73] Assignee: UOP Inc., Des Plaines, Ill.

[21] Appl. No.: 153,808

[22] Filed: May 27, 1980

[51] Int. Cl.[3] ..... E03B 3/18; E21B 43/08

[52] U.S. Cl. ..... 166/233; 29/458; 210/497.1; 210/506

[58] Field of Search ..... 166/233, 231, 232, 227, 166/205, 157; 210/497.1, 506; 29/458, 469

[56] References Cited

U.S. PATENT DOCUMENTS

| | | | |
|---|---|---|---|
| 1,638,731 | 8/1927 | Hanson | 166/233 |
| 2,081,190 | 5/1937 | Wilson | 166/233 |
| 3,385,373 | 5/1968 | Brown | 166/233 X |
| 3,601,192 | 8/1971 | Layne et al. | 166/232 |
| 3,937,281 | 2/1976 | Harnsberger | 166/233 |
| 4,045,591 | 8/1977 | Payne | 166/244 C |
| 4,167,972 | 9/1979 | Sears | 166/233 |

*Primary Examiner*—Stephen J. Novosad

*Attorney, Agent, or Firm*—James R. Hoatson, Jr.; Barry L. Clark; William H. Page II

[57] ABSTRACT

Assembly of a coated screen jacket and a coated pipe base is held together by radially positioned fasteners such as shear pins which pass through overlapping portions of male and female slip fittings which are welded to the screen jacket and pipe base before it is coated. The mating fittings include an internal groove for mounting an O-ring. Since the screen jacket has complementary male and female fittings on its opposite ends, a plurality of short screen jacket portions can be easily mounted in series on a pipe base member.

8 Claims, 5 Drawing Figures

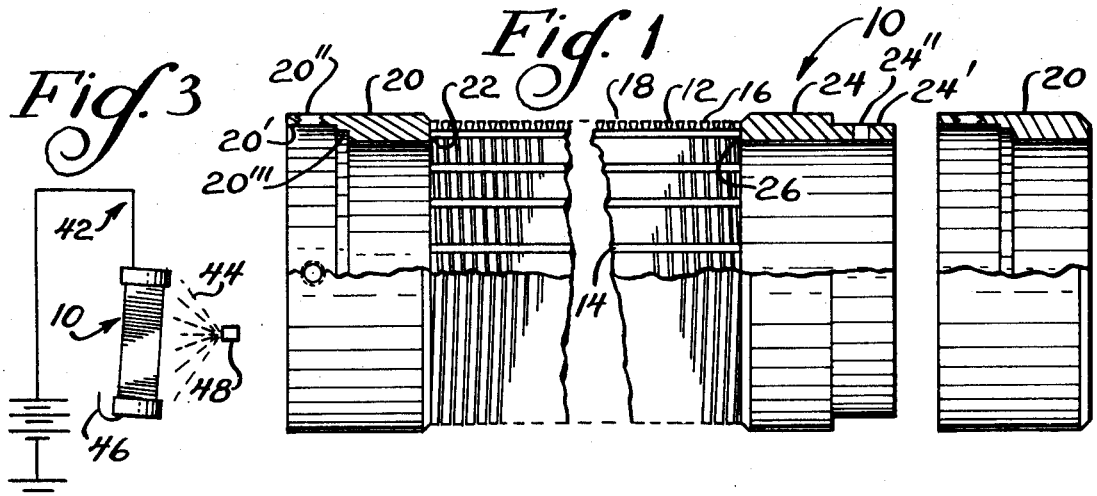
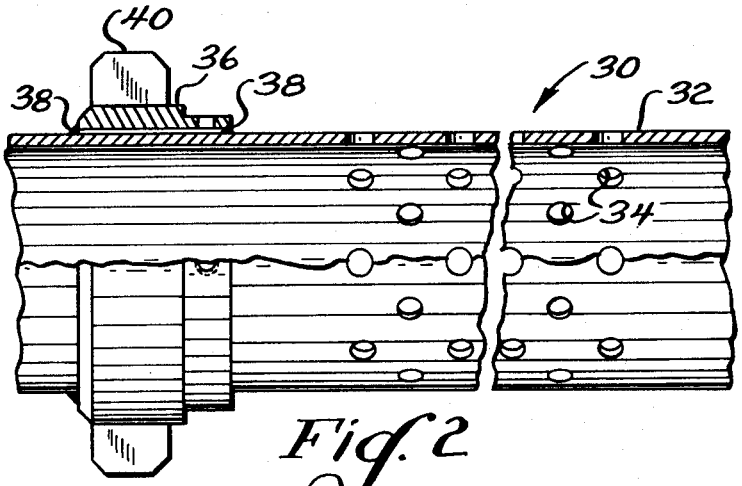
Fig. 2
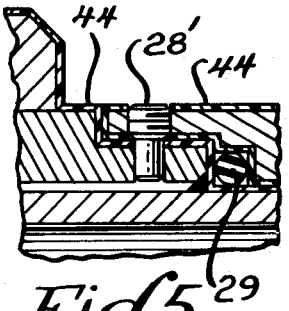
Fig. 5
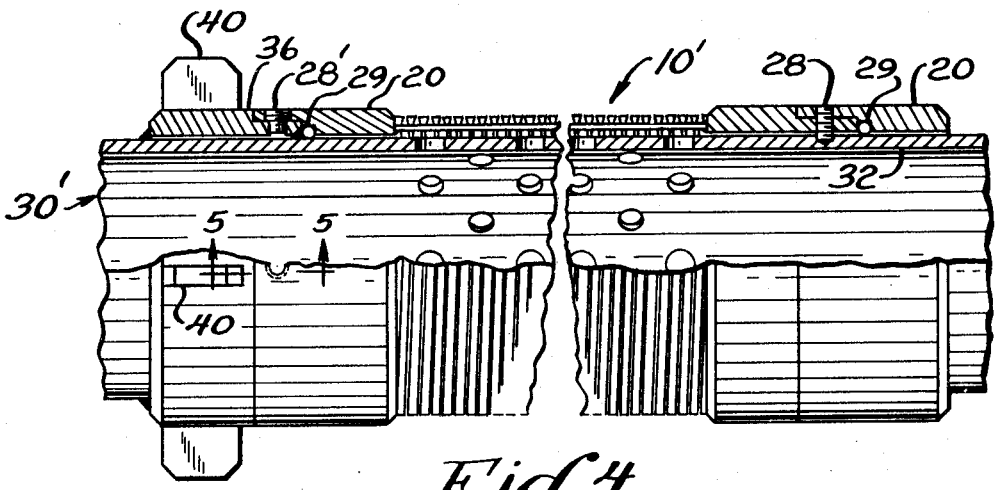
Fig. 4

COATED SCREEN JACKET AND COATED PIPE BASE ASSEMBLY AND METHOD OF MAKING SAME

BACKGROUND OF THE INVENTION

The invention relates to well screens and particularly to such screens which are formed by welding a slotted screen jacket to a perforated pipe base support. In water wells, it is usually possible to merely weld a screen, typically one made of stainless steel, to one end of a length of well casing. However, in oil wells, which typically are much deeper, the additional strength of a pipe base support is often required. Although corrosion resistance is important, the cost of using stainless steel screen jackets and pipe bases in large installations could be extremely expensive. To help reduce the expense, it has been proposed that the screen jacket and pipe base be made of low cost steel and provided with a protective coating such as a layer of electrostatically sprayed epoxy. Unfortunately, the coating cannot be applied after assembly of the screen jacket to the pipe base since it cannot be applied uniformly. Furthermore, when an attempt is made to coat the jacket and pipe base separately and then weld them directly to each other or to a common joining ring, the coating is destroyed in the area of the welds.

SUMMARY OF THE INVENTION

It is among the objects of the present invention to provide an assembly of a coated screen jacket and a coated pipe base and a method of making such an assembly without harming the coating. It is an additional object to make such an assembly in such a way that the screen jacket can be disassembled from the pipe base or additional lengths of screen jacket can be added. The foregoing and other objects and advantages are attained by the improved structure of the present invention and by the improved method of making same. The structure includes a pipe base member which has an annular male slip fitting welded to the outside wall thereof, and a screen jacket member which has an annular female slip fitting welded to one end thereof and is adapted to complementarily engage the annular male fitting in a telescoping fashion. An annular recess in the inner wall of the female fitting is adapted to receive an elastomeric O-ring to seal the screen jacket relative to the pipe base. A male slip fitting is welded to the opposite end of the screen jacket. This male fitting permits additional screen jackets to be attached in series to the first one or, where only one screen jacket is required, be mated to an annular female slip fitting which contains an annular recess for retaining an O-ring for sealing the free end of the screen jacket relative to the pipe base.

BRIEF DESCRIPTION OF THE DRAWINGS

FIG. 1 is a side view, partially in section, of a screen jacket which has male and female fittings welded on each of its ends, and a female slip fitting which is adapted to mate with the male end fitting;

FIG. 2 is a side view similar to FIG. 1 but illustrating a pipe base member having a male fitting welded to a portion thereof;

FIG. 3 is a diagrammatic view illustrating the step of electrostatically spray coating the screen jacket and pipe base;

FIG. 4 is a side view, partially in section, showing the coated screen jacket and coated pipe base after they are assembled; and FIG. 5 is an enlarged view of the section taken on line 5—5 of FIG. 4 showing the coatings eliminated from FIG. 4 for clarity.

DESCRIPTION OF THE PREFERRED EMBODIMENT

FIG. 1 illustrates a screen jacket assembly indicated generally at 10 which includes a screen section 12 formed of longitudinal rods 14 and a wrap wire 16 which is welded to rods 14 so as to define slot openings 18. A female fitting 20 is attached by a weld 22 to one end of the screen section 12 and a male fitting 24 is attached by a weld 26 to the opposite end. The inner wall 20' of the female fitting 20 is sized so as to telescopically overlie the outer wall 24' of the male fitting 24 on a second screen jacket 10 (not shown) when two or more such screen jackets are combined together. The fittings 20 and 24 contain apertures 20'' and 24'' which may be radially aligned and fitted with shear pins 28 (FIG. 4) to lock the fittings to each other. The overlapping walls 20' and 24' of the fittings are provided with diameters such that telescopic assembly can still be accomplished after the fittings have been coated with a protective coating 44. The female fitting 20 has a shouldered recess 20''' which accommodates a sealing ring 29 (FIG. 4). The female fitting 20 shown at the right of FIG. 1 is adapted to receive a sealing ring 29 as shown in FIG. 4 and be pinned to the screen jacket 10' so as to seal its right end relative to the underlying pipe base 30'.

FIG. 2 illustrates a pipe base assembly indicated generally at 30 which includes a pipe base member 32 having perforations 34 along a portion of its length. A male fitting 36 is welded to an unperforated portion of the pipe base 32 by a pair of weld beads 38. The fitting 36 is preferably identical to the fitting 24 except that it may have centralizer tabe 40 attached to it.

FIG. 3 diagrammatically illustrates an apparatus 42 for performing the step of electrostatically spray coating the screen jacket assembly 10 with a coating of a material such as epoxy 44. The assembly 10 is mounted on a conductive carrier arm 46 which causes the assembly to be at one polarity so that the spray 44 which is discharged from a nozzle 48 of the opposite polarity, will be attracted to it. The pipe base assembly 30 would, of course, be coated in a similar fashion.

FIG. 4 shows the assembly of the elements 10' and 30', the latter elements being the elements 10, 30 but with a coating of protective, corrosion resistant material such as a 0.003–0.005'' thick layer of epoxy applied uniformly to all portions thereof. The thin coating 44 does not show in FIG. 4 but is visible in FIG. 5 which is an enlargement of the section taken on line 5—5 of FIG. 4 with the coating thickness exaggerated for clarity. The shear pins 28, 28' are preferably threaded and may be formed to engage the pipe base 32 or not, depending upon whether the user of the screen assembly prefers one end of the jacket assembly 10' to float free. For example, the pin 28 is shown as being formed like a set-screw so as to engage a partially drilled hole in the base 32. The pin 28' is formed with a shoulder so that it is prevented from engaging the pipe base. Regardless of which type of fastener is used, a dab of coating material or touch-up primer is preferably placed over the head of the fastener to seal it and the underlying threads which are preferably left uncoated.

I claim as my invention:

1. A pipe base well screen assembly comprising an internal metallic pipe member having an extended perforated region and non-perforated regions at each end of said perforated region, a metallic fitting welded to said pipe member in one of said unperforated regions, a layer of corrosion resistant bonded coating material completely covering all exposed portions of said pipe member and said welded metallic fitting; a metallic screen jacket member having flow openings therein which overlie the perforated region of said pipe member and a metallic, male-shaped fitting welded to one of its ends and a complementary female-shaped fitting welded to the other of its ends, a layer of corrosion resistant bonded coating material completely covering all exposed portions of said screen jacket portion and said welded metallic fittings, one of said fittings on said screen jacket member being telescopically engaged with said fitting on said pipe member and affixed thereto by a first plurality of fasteners which pass radially through overlapping portions of each of the engaged fittings, and O-ring seals in engagement with each of said fittings and with the non-perforated regions of said pipe member for preventing passage of fluid between said screen jacket and pipe member except through said flow openings.

2. The well screen assembly of claim 1 wherein an annular slip fitting is telescopically engaged with the other of said fittings on said screen jacket member and affixed thereto by a second plurality of fasteners which pass radially through overlapping portions of the engaged fittings.

3. The well screen assembly of claim 2 wherein said metallic fitting which is welded to said pipe member is a male-shaped fitting and said annular slip fitting is female-shaped.

4. The well screen assembly of claim 2 wherein said second plurality of fasteners have portions which extend partially into the wall of the pipe member so as to prevent relative movement between the fitting, the screen jacket, and the pipe member.

5. The well screen assembly of claim 4 wherein said second plurality of fasteners are in threaded engagement with at least one of said fittings.

6. The well screen assembly of claim 2 wherein said second plurality of fasteners have shoulder portions which prevent their extending beyond the engaged fittings and engaging the pipe member.

7. A method of assembling a coated screen jacket to a coated pipe base which has perforations along a portion of its length comprising the steps of welding a male slip fitting to one end of an uncoated screen jacket and welding a complementary, female slip fitting to the other end thereof; welding a slip fitting which is complementary to one of said slip fittings on said screen jacket to said pipe base in an area thereof which is spaced from and axially adjacent to said perforated portion; applying a protective layer of coating material to said screen jacket and its slip fittings and to said pipe base and its fitting while said screen jacket and pipe base are out of assembled relationship; assembling said coated screen jacket and slip fitting to said coated pipe base so that said complementary slip fittings telescopically engage each other and an O-ring sealing member positioned on one of said fittings which engages the other of the fittings and the pipe base; placing a plurality of retaining fasteners into aligned, radially directed apertures in said telescopically engaged slip fittings to anchor said screen jacket to said pipe base; and placing an additional O-ring sealing member in contact with the pipe base and with the end of said screen jacket which is remote from said engaged slip fittings.

8. A method in accordance with claim 7 wherein an annular slip fitting member is assembled to said pipe base and engaged to said screen jacket.

* * * * *